United States Patent [19]

Tupper

[11] 4,277,292

[45] Jul. 7, 1981

[54] TERNARY CORROSION RESISTANT COATINGS

[75] Inventor: George L. Tupper, Gurnee, Ill.

[73] Assignee: Coral Chemical Company, Waukegan, Ill.

[21] Appl. No.: 134,220

[22] Filed: Mar. 26, 1980

[51] Int. Cl.[3] ..... C23F 7/00

[52] U.S. Cl. ..... 148/6.27; 148/6.14 R

[58] Field of Search ..... 148/6.27, 6.15 R, 6.14 R

[56] References Cited

U.S. PATENT DOCUMENTS

| | | | |
|---|---|---|---|
| 3,964,936 | 6/1976 | Das | 148/6.27 |
| 4,017,334 | 4/1977 | Matsushima et al. | 148/6.27 |
| 4,054,466 | 10/1977 | King | 148/6.27 |

FOREIGN PATENT DOCUMENTS

| | | | |
|---|---|---|---|
| 2446492 | 4/1975 | Fed. Rep. of Germany | 148/6.15 R |
| 2704260 | 8/1978 | Fed. Rep. of Germany | 148/6.27 |

*Primary Examiner*—Ralph S. Kendall

*Attorney, Agent, or Firm*—John S. Roberts, Jr.

[57] ABSTRACT

A highly acidic aqueous conversion coating for aluminum which is corrosion resistant, provides excellent adhesion with overlaying coatings and does not blacken when the coating substrate is immersed in boiling water. The coating composition is a ternary variety which contains zirconium, fluoride, and tannin. The pH of the coating bath is uniquely more acidic than conventional baths which operate at a pH of 3 and above, and is between 2.3 and 2.95.

18 Claims, No Drawings

TERNARY CORROSION RESISTANT COATINGS

PRIOR ART STATEMENT

U.S. Pat. No. 3,964,936 to Das is related to coating aluminum substrate with a coating which contains zirconium, fluoride and boron and the pH of the solution is about 3 to 5. Optionally, the coating may contain nitric acid. This coating shows corrosion resistance and adhesion.

U.S. Pat. No. 4,054,466 shows a 2-stage tannin in which the first stage treatment also contains titanium and fluoride. The pH of the solution must be at least 3.

These patents do not show the inventive formulation and teach the necessity for high (over 3) pH in the treating baths.

BACKGROUND OF THE INVENTION

The invention is concerned with both the treating solution and process for applying a thin coating solution to an aluminum surface. It is particularly applicable for treating cleaned aluminum cans prior to the application of a decorative organic finish. The value of a good coating represents a substantial saving in cost and operating expense for it obviates the need to apply organic finish to the bottom of aluminum cans. However, the treating solution must be sufficiently satisfactory to improve the corrosion resistance of the can bottom.

In the past, satisfactory corrosion resistance and concomitant good adhesion of the organic finish were provided by typical metal treatment solutions composed of about 1% solution of a mixture of hexavalent chromium, phosphoric acid and fluoride. Greater sensitivity to preserving a clean, safe environment has caused industry to abandon these toxic compositions and to develop acceptable coatings which also provide adequate protection for the cans. There has been considerable investigative effort in this direction, with proper attention to extensive parameters of composition, concentration, pH, pretreatment, etc.

The compositions especially must meet the "pasteurization" test. Basically, the cans must be resistant to discoloration when subjected to moderately hot water for a half hour period of time. This is the industry-wide corrosion resistance test commonly referred to as "pasteurization." The test causes an uncoated or poorly coated aluminum surface to blacken or discolor in an unsightly and unacceptable fashion.

Coatings which pass the pasteurization test must additionally satisfy the tests to determine the quality of the adhesion of the subsequently applied organic coatings. Preferred coatings perform satisfactorily in both tests.

It is known that zirconium and fluoride compositions with boron provide satisfactory coatings. However, these compositions operate at a high pH, so that the coating solution bath must always be monitored for acid depletion and possible precipitation of the zirconium ion.

Tannin has been employed in coatings but has been demonstrated to be ineffective at pH values below 3. Tannin has been admixed variously with lithium, fluoride, and titanium ions.

SUMMARY OF THE INVENTION

It has now been discovered that a satisfactorily corrosion resistant and adhesion enhancing coating for aluminum surfaces can be obtained at pH values of 2.3 to 2.95. It is totally unexpected that satisfactory coatings can be produced at this range of pH. The composition contains zirconium and fluoride ions and tannin in an effective amount. The zirconium ion concentration varies between 1.4 and 4.8 grams/liter in the concentrate solution of 0.014 and 0.096 grams/liter in the treatment bath. This may also be expressed as 14–96 ppm in the treating bath. The fluoride, both free and complex, varies between 0.020 and 0.140 grams/liter or 20–140 ppm in the treating bath, and the tannin between 0.060 and 0.240 grams/liter, or 60 to 240 ppm in the treating bath. The coating compositions can be applied to aluminum substrates, particularly aluminum cans which have been pretreated with an acid cleaner (environmentally acceptable) and water rinses.

DETAILED DESCRIPTION OF THE INVENTION

The aluminum, especially in the forms of cans, is treated in a procedure which is as follows:

1. Clean drawn and ironed aluminum cans in 1% solution of a hot aqueous sulfuric acid solution containing a modified linear aliphatic polyether surfactant, followed by cold water rinse to a no-water-break surface;
2. Immerse cans in a treating bath, 1½% v/v treating solution (40–60 ml in 4000 ml), 30 seconds, 110° F.; followed by a cold tap water rinse and a deionized water rinse.
3. Dry in oven, 350° F., for 5 minutes;
4. Apply decorative organic finish to the exterior;
5. Cure organic finish at elevated temperatures;
6. Apply interior sanitary lacquer; and
7. Cure interior sanitary lacquer.

The coating composition contains zirconium ions, fluoride ions, tannin, acid, preferably nitrate ion, and water.

The zirconium source is a soluble zirconium source such as ammonium zirconyl carbonate, zirconium orthosulfate, zirconium oxynitrate, zirconium hydroxide, ammonium zirconyl fluoride, and zirconium fluorides. The zirconium ion is present in the concentrate solution in the amount of 1.4 to 4.8 grams/liter. In the coating solution (applications varying between 1 and 2% v/v solutions), the zirconium is 14–96 ppm.

The fluoride ion source is typically an acid, although soluble salts are possible. Hydrofluosilicic acid or hydrofluoric acid are readily available chemicals and have the additional value of contributing hydrogen ion to increase the acidity to the preferred range. Of course, soluble fluoride salts may be used.

The total fluoride is present in the concentrate in the range of 2.0 to 7.0 grams/liter, in the coating solution 20–140 ppm.

The acidifying agent is typically nitric acid. Nitric is preferred, for the nitrate ion is believed to function as an accelerator in the composition. Typically, the nitric acid is 2–5% of the concentrate and 200–1000 ppm in the coating solution. Of course, the governing acid criteria is a maintenance of a pH between 2.3 and 2.95. Sulfuric or acetic acid, etc. may be used to provide hydrogen ions.

The vegetable tannins are commercially available from Mallinkrodt, Inc., St. Louis, Mo. A wide variety of commercially available tannins may be used. For a discussion of tannins, see *Encyclopedia of Chemical Technology*, 2nd edition, Kirk-Othmer; XII (1967) pp. 303–341.

Tannins are generally characterized as polyphenolic substances having molecular weights of from about 400 to about 3000. They may be classified as "hydrolyzable" or "condensed" depending upon whether the product of hydrolysis in boiling mineral acid is soluble or insoluble, respectively. Often, extracts are mixed and contain both hydrolyzable and condensed forms. No two tannin extracts are exactly alike. Principal sources of tannin extracts include bark such a wattle, mangrove, oak, eucalyptus, hemlock, pine, larch, and willow; woods such as quebracho, chestnut, oak, and urunday, cutch, and turkish; fruits such as myrobalans, valonia, dividivi, tera, and algarrobilla; leaves such as sumac and gambier; and roots such as canaigre and palmetto.

The term "vegetable tannin" is employed to distinguish organic tannins such as those listed in the previous paragraph from the mineral tanning materials.

Hydrolyzable, condensed and mixed variations of vegetable tannins are suitable for the present invention. The tannin of the ternary composition present in the concentrate is between 6.0 and 12.0 grams/liter and 0.060 and 0.240 grams/liter in the coating solution as 60–240 ppm.

The pH of the treating solution is maintained between 2.3 and 2.95. As indicated above, nitric and hydrofluoric are preferred. Ammonium hydroxide may be added to achieve the upper pH value. Phosphate ion and chloride ion are not used for environmental considerations. At pH values less than 2.3, some blackening occurs. At pH values above 2.95, blackening also occurs.

The coating solution can be applied to the aluminum in a variety of methods employed by the industry. For example, the solution can be applied by spraying, immersion, or flow-coating techniques. Spraying is effective and economical.

The temperature of the coating solution is between 100° and 130° F. Generally, it is 110° F. The aluminum is in the bath for about 30 seconds.

Before immersing the aluminum, it is cleaned. Available acid or alkaline cleaners, well-known in the art, are used. After cleaning, the surface is water rinsed and finally deionized water rinsed. No chromium or phosphate treatment is used.

After the coating has been applied, it is dried, for example, in forced hot air circulating ovens at 350° F. for 5 minutes.

Subsequently, the decorative organic coating of lacquer, ink or resin is applied and, in the case of cans used for foods or beverages, a sanitary interior coating is applied.

The coatings have a general thickness of 200 to 750 Å and a weight within the range of 10 to 35 mg/sq. ft.

A preferred embodiment of the invention is a coating composition of a ternary variety of zirconium ions of 30–45 ppm, fluoride ions of 30–70 ppm, and vegetable tannin of about 100 ppm. The pH is preferably 2.4–2.8.

CORROSION RESISTANCE OF PASTEURIZATION TEST

This test is a measure of the resistance to discoloration of a substrate which has been treated but to which no organic finish has been applied. The bottom of the can, cut from a side wall, is immersed and heated to 150° F. for 30 minutes in water which contains 0.5 gram sodium chloride and 1.0 gram sodium bicarbonate per liter of water. The surface is then observed for discoloration.

BOIL TEST

A sample of an aluminum can bottom is boiled in tap water for 5 minutes. The surface is observed for discoloration.

MUFFLE FURNACE TEST

A sample of aluminum can bottom is heated in a muffle furnace at 1000°±50° F. for 5 minutes. A yellow to brown color indicates the presence of a coating.

TAPE ADHESION

This test is a measure of the adhesion between an organic finish and a treated substrate. The painted surface is subjected to a standard boil test or pasteurization test, rinsed in tap water, cross-hatched (approximately 64 squares/sq. inch), and dried. Scotch-brand transparent tape is then applied to the cross-hatched area, pulled away, and the amount of paint removed by the tape is observed.

The following examples show comparative examples of inventive examples intended to teach one how to practice the invention.

COMPARATIVE EXAMPLE 1

This is not illustrative of the invention.

A treating solution is prepared as follows:

| Treating Bath #1 | | % |
|---|---|---|
| Water | 955.0 g | 95.5 |
| Nitric Acid, 42° Be | 28.0 g | 2.8 |
| Hydrofluosilicic acid 30% | 3.0 g | .3 |
| Ammonium zirconyl carbonate | 14.0 g | 1.4 |
| | 1000.0 g | 100% |

The drawn and ironed aluminum cans are cleaned in a 1% solution of a hot aqueous sulfuric acid cleaner and rinsed with cold water to a no-water-break surface. The cans are immersed in a 1½% v/v solution (40–60 ml in 4000 ml) of the above for 30 seconds at 120° F. The pH is 2.6. A cold tap water rinse follows. The cans are dried in the oven for 5 minutes at 350° F.

The following tests are done on the bottom of a can, cut from side wall.

a. Reynolds Metals TR3Test

The bottom is heated at 150° F. for 30 minutes, immersed in a solution of 0.5 grams sodium chloride, 1.0 gram sodium bicarbonate and water to make 1 liter.

Result: The can bottom is brown.

b. The can bottom is heated in a muffle furnace at 1000° F.±50° F. for 5 minutes.

Result: No color.

COMPARATIVE EXAMPLE 2

This is not illustrative of the invention.

The above process for Example 1 is repeated with the exception that 1.0 gram of lignin sulfonate, available from American Can Company under the designation Kelig 32, is added to the treating solution. The pH of the bath is 2.8.

Result:

TR3: brown—unsatisfactory

Furnace: no color.

COMPARATIVE EXAMPLE 3

This is not illustrative of the invention.

The above Example 2 is repeated with the single exception that the quantity of Kelig 32 is 1.29 grams and the pH is 3.1.

Result:

TR3: brown—unsatisfactory

Furnace: no color.

COMPARATIVE EXAMPLE 4

This is not illustrative of the invention. The process of Example 1 is repeated with the exception that 0.6 gram of N,N,N',N'-tetra-bis-(2-hydroxy propanol)ethylene diamine, available from BASF Wyandotte under the tradename Quadrol, is added to the treating solution #1. The pH is 2.8.

Results:

TR3: brown—unsatisfactory

Furnace: no color.

COMPARATIVE EXAMPLE 5

This is not illustrative of the invention.

The procedure of Example 4 is followed, with the single exception that ammonium hydroxide is added to increase the pH to 5.0.

Results:

TR3: brown—unsatisfactory

Furnace: no color.

COMPARATIVE EXAMPLES 6-12

These are not illustrative of the invention. Treating solution from Example 1 is used on the cans as described, at the pH and concentration shown in Table 1. Can bottoms are treated by boiling for 5 minutes in tap water. The results are given in the Table.

| Example | pH | % Conc. of Treating Solution #1 | Boil Test Results |
|---|---|---|---|
| 6 | 3.1 | 1.24 | 100% even dark stain |
| 7 | 3.0 | 1.35 | 100% even dark stain |
| 8 | 2.9 | 1.49 | 100% even medium stain |
| 9 | 2.8 | 1.66 | 100% even light stain |
| 10 | 2.7 | 1.85 | 100% even light stain |
| 11 | 2.6 | 2.10 | 100% even dark stain |
| 12 | 2.5 | 2.43 | 100% even dark stain |

INVENTIVE EXAMPLES 13-14

This is illustrative of the invention. The following solution is prepared:

| | |
|---|---|
| Water | 941.5 grams |
| Nitric acid, 42° Be | 28.0 grams |
| Hydrofluosilicic acid 30% | 3.0 grams |
| Ammonium zirconyl carbonate 20% | 14.0 grams |
| Mallinckrodt tannic acid | 10.0 grams |
| Hydrofluoric acid 70% | 3.5 grams |
| | 1000.0 grams |

The treating bath is made at 1% v/v (40 ml treating solution diluted to 4000 ml). The procedure of Examples 13-14 is repeated. The pH is 2.95.

Results:

TR3: no discoloration after 30 minutes

Furnace: develops bright golden color.

INVENTIVE EXAMPLE 15

This is illustrative of the invention.

The above solution is used and applied at 1½% v/v. The pH is 2.60.

Results:

TR3: no discoloration

Furnace: develops bright golden color.

INVENTIVE EXAMPLE 16

This is illustrative of the invention. The following solution is prepared:

| | |
|---|---|
| Water | 913.0 grams |
| Nitric acid 42° Be | 46.0 grams |
| Hydrofluosilicic acid 30% | 5.0 grams |
| Ammonium zirconyl carbonate 20% | 21.0 grams |
| Tannic acid | 10.0 grams |
| Hydrofluoric acid 70% | 5.0 grams |

The procedure of Examples 13-14 is followed with the exception that a 2% v/v solution of the above is used. The pH is 2.3.

Results:

TR3: no discoloration

Furnace: light yellow.

INVENTIVE EXAMPLE 17

This is illustrative of the invention. The above cleaning solution is used with the single exception that ammonium hydroxide is added to increase the pH to 2.85.

Results:

TR3: no discoloration

Furnace: light yellow.

Comparative Examples 1-5 indicate that an aluminum surface treated with a solution containing fluoride and zirconium ions at pH values of less than 3 fail to pass the pasteurization test.

Comparative Examples 6-12 show that aluminum cans treated with a solution containing fluoride and zirconium ions at pH values between 2.5 and 3.0 do not pass the boil test.

ADHESION TEST RESULTS

Cans treated with the inventive formulation shown in Example 15 were additionally processed with a decorative coating at Reynolds Metals Company, Tampa, Fla., on an experimental use basis. Adhesion tests of the type described above were performed and the results were satisfactory.

Reynolds at Tampa used the treating solution described in Examples 13-14 supplied by Coral and processed the cans with a spray of the solution. Cans were pulled from the processing stations for pasteurization tests to see that no blackening occurred. Muffle furnace tests were done in order to see that the coating was present. If no coating is present, the cans do not turn a yellow or brown color.

In order to run the line at varying parameters, Coral in Waukegan was asked by Reynolds, after the above runs were completed, to supply another formulation. Examples 13-14 shows this formulation. In Tampa, this formulation gave satisfactory results, but Reynolds requested a more acidic solution.

Coral supplied the formulation described in Example 16 and the cans were coated at a pH of 2.3. Pasteurization and furnace tests proved satisfactory.

Reynolds indicated they wished to try the same formulation as above and at the same dilution but with a different pH. Coral indicated adjustments with ammonium hydroxide to increase the pH to 2.85.

Reynolds indicated they were satisfied with the test solutions in the pH ranges applied.

What is claimed is:

1. An acidic aqueous coating solution for forming a corrosion resistant coating on aluminum consisting essentially of a ternary composition of zirconium, a soluble vegetable tannin, and a fluoride, wherein the concentration of the zirconium ion is 0.014 to 0.096 grams/liter, the vegetable tannin concentration is 0.060 to 0.024 grams/liter, and the fluoride concentration is 0.020 to 0.140 grams/liter, and excluding phosphate ion and a source of hydrogen ion to adjust the pH of the coating solution between 2.3 and 2.95.

2. A coating composition of claim 1 wherein the source of hydrogen ion is nitric acid.

3. A coating composition of claim 1 wherein the source of hydrogen ion is selected from the group consisting of nitric acid, acetic acid, and sulfuric acid.

4. An acidic aqueous coating solution for forming a corrosion resistant coating on aluminum consisting essentially of an composition of zirconium, a soluble vegetable tannin, a fluoride and nitric acid wherein the concentration of the zirconium ion is 0.014 to 0.096 grams/liter, the vegetable tannin concentration is 0.060 to 0.240 grams/liter, nitric is present in an amount to adjust the pH of the coating solution between 2.3 and 2.95.

5. A method of coating an aluminum substrate with a corrosion resistant coating comprising the steps of:

I. preparing a clean, washed and rinsed aluminum surface;

II. contacting the aluminum surface for about 30 seconds with a coating solution of claim 1;

III. reacting said solution with the aluminum surface to produce an aluminum surface which is corrosion resistant and provides improved adhesion.

6. A method of claim 5, wherein the coating solution contains nitric acid.

7. A highly acidic aqueous coating solution having a pH between 2.3 and 2.95 and consisting essentially of 30–45 ppm zirconium ions, 75–125 ppm vegetable tannin, and 30–70 ppm fluoride, and excluding phosphate ion, suitable for forming a corrosion resistant coating on aluminum.

8. A coating solution according to claim 7, which includes nitric acid.

9. A coating solution of claim 8, wherein nitrate ion is present in the amount of 200–1000 ppm.

10. A coating composition of claim 7, wherein the source of zirconium is selected from the group consisting of ammonium zirconyl carbonate, zirconium orthosulfate, zirconium oxynitrate, zirconium hydroxide, zirconium fluoride, and ammonium zirconyl fluoride.

11. A coating solution of claim 7, wherein the source of zirconium is ammonium zirconyl carbonate.

12. A method for coating an aluminum substrate comprising the steps of:

I. preparing a clean, washed and rinsed aluminum surface;

II. contacting the aluminum surface for about 30 seconds with an acidic solution consisting essentially of 30–45 ppm zirconium ions, 75–125 ppm vegetable tannin, and 30–70 ppm fluoride ions, and excluding phosphate ion, said solution being maintained at a pH between 2.3 and 2.95;

III. reacting said solution with the aluminum surface to produce an aluminum surface which is corrosion resistant and provides improved adhesion.

13. A method of claim 12, wherein said solution contains nitric acid.

14. A method of claim 13, wherein the nitrate ion is present in the range of 200–1000 ppm.

15. A method of claim 12, wherein the temperature of the coating solution is about 110°–130° F.

16. A method of claim 12, wherein the aluminum substrate is contacted with the solution by immersion.

17. A method for coating aluminum can stock comprising the steps of:

I. preparing a clean, washed and rinsed aluminum can;

II. contacting the surface of the can for about 30 seconds at a temperature between 100° and 130° F. with an acidic solution of a ternary composition consisting essentially of zirconium ions, fluoride ions, and soluble vegetable tannin, and excluding phosphate ion, said solution being maintained at a pH between 2.3 and 2.95 and wherein the concentration of zirconium is between 0.014 and 0.096 grams/liter, the fluoride concentration is between 0.020 and 0.140 grams/liter, and the tannin concentration is between 0.060 and 0.240 grams/liter;

III. reacting said solution with the can surface to produce a coating on the can which is corrosion resistant and provides improved adhesion.

18. A method of claim 17, including an additional step of pasteurizing the can.

* * * * *